US006448871B1

(12) United States Patent
Hiroshima et al.

(10) Patent No.: US 6,448,871 B1
(45) Date of Patent: Sep. 10, 2002

(54) DIELECTRIC FILTER, DIELECTRIC DUPLEXER, AND COMMUNICATION APPARATUS

(75) Inventors: Motoharu Hiroshima; Hideyuki Kato, both of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/929,669

(22) Filed: Aug. 14, 2001

(30) Foreign Application Priority Data

Aug. 18, 2000 (JP) ..... 2000-248445

(51) Int. Cl.[7] ..... H01P 5/12; H01P 1/20; H01P 3/06

(52) U.S. Cl. ..... 333/134; 333/202; 333/206

(58) Field of Search ..... 333/202, 206, 333/134, 222, 204, 135, 208

(56) References Cited

U.S. PATENT DOCUMENTS 6,002,307 A * 12/1999 Arakawa ..... 333/135
6,087,909 A * 7/2000 Toda et al. ..... 333/134
6,222,431 B1 * 4/2001 Ishizaki et al. ..... 333/206

* cited by examiner

*Primary Examiner*—Patrick Wamsley
(74) *Attorney, Agent, or Firm*—Dickstein, Shapiro, Morin & Oshinsky, LLP

(57) ABSTRACT

A dielectric filter which corrects the mismatch of the resonance frequencies of resonators formed by internal conductors between a balanced terminal side and an unbalanced terminal side of the filter, and which is capable of easily obtaining a predetermined external coupling capacitance. Also, a dielectric duplexer, and a communication apparatus having the filter are obtained. Inside a dielectric block, a plurality of internal-conductor holes have different cross-sectional sizes, in which both ends thereof are open and internal conductors are formed on the inner surfaces. Also, the outer surface of the dielectric block is formed with an external conductor over four surfaces, but not on the opening surfaces of both ends of the internal-conductor holes. A pair of balanced terminals are coupled to the ends of one of the internal conductors, and an unbalanced terminal is coupled to one of the end portions of another internal conductor. An external-conductor-removed section may also be formed in a portion in the vicinity of the end portion of the other internal conductor. In this manner, the dielectric filter is formed.

10 Claims, 7 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter, which comprises an internal-conductor hole formed inside a dielectric block and an external conductor formed on the outer surface thereof, a dielectric duplexer, and a communication apparatus using the filter and duplexer.

2. Description of the Related Art

The construction of a conventional dielectric filter with a balanced-to-unbalanced transform function using dielectric block will now be described with reference to FIGS. 8A and 8B.

FIG. 8A is an exterior perspective view of a dielectric filter facing up. FIG. 8B is a sectional view taken along the plane passing through the holes. In this example, the inner diameters of the internal-conductor holes have a stepped structure wherein the ends of each internal-conductor hole have an inner diameter of D1 and the central portion of each hole has an inner diameter of D2.

In FIGS. 8A and 8B, reference numeral 1 denotes a dielectric block. Inside the dielectric block 1, internal-conductor holes, indicated by 2*a* and 2*b*, are provided, and both ends thereof are open. The inner surfaces of the internal-conductor holes have internal conductors 3*a* and 3*b* formed thereon. Also, the outer surface of the dielectric block 1 is formed with external conductors on four surfaces, but not on the end surfaces at which the open ends of the internal-conductor holes 2*a* and 2*b* are formed. Balanced terminals 5 and 6 which are coupled respectively to the open ends of one of the internal conductors 3*a* and an unbalanced terminal 7 which is coupled to one of the open ends of the other internal conductor 3*b* are formed on the outside of the dielectric block 1 and isolated from the external conductor 4.

In such a conventional dielectric filter, there are problems to be solved, such as those described below.

For example, in a dielectric filter with a balanced-to-unbalanced transform function, the number of external terminals associated with each internal conductor differs, for example, two external terminals may be provided on the balanced side and one external terminal may be provided on the unbalanced side. Thus, although the resonance frequencies of the respective internal conductors should match, the resonance frequency of the internal conductor on the balanced terminal side is higher than the resonance frequency of the internal conductor on the unbalanced terminal side.

Also, in a case where the characteristic impedance of a line coupled to an external source differs between the balanced terminal side and the unbalanced terminal side, the necessary coupling capacitance does not match between the balanced terminal side and the unbalanced terminal side. As a result, degradation of filter characteristics, for example, an increase in reflection loss, occurs, and signals deteriorate during the balanced-to-unbalanced conversion.

SUMMARY OF THE INVENTION

The present invention addresses these problems and provides a dielectric fitter, in which the mismatch of the resonance frequency between the balanced terminal side and the unbalanced terminal side is corrected, and a desired external coupling capacitance can be obtained so that even if the characteristic impedance of a line coupled to an external source differs from a preferred characteristic impedance, superior reflection loss characteristics can be obtained in such a manner as to compensate for the impedance. The invention also provides a dielectric duplexer; and a communication apparatus having either or both of the filter and duplexer.

To this end, in one aspect, the present invention provides a dielectric filter provided with a plurality of internal-conductor holes, each having an internal conductor formed on the surface thereof inside a dielectric block which has a substantially rectangular parallelepiped shape, having both ends or the portions in the vicinity of both ends formed as open ends, and having an external conductor formed on the outer surface of the rectangular parallelepiped. The dielectric filter comprises a pair of balanced terminals, which are coupled respectively to the portions in the vicinity of the open ends of the internal conductor formed in a predetermined one of the internal-conductor holes; and an unbalanced terminal which is coupled to the vicinity of one of the open ends of the internal conductor formed in another one of the internal-conductor holes. The internal-conductor hole in which is formed the internal conductor to which the balanced terminal is coupled and the internal-conductor hole in which is formed the internal conductor to which the unbalanced terminal is coupled are differently sized in cross-section. With this construction, the resonance frequency of the internal conductor which is coupled to the balanced terminal and the resonance frequency of the internal conductor which is coupled to the unbalanced terminal, which differ in the prior art, are made to match. Furthermore, the external coupling capacitance can be set as desired.

The internal-conductor holes may be formed into a stepped structure made up of plural layers, in which the size of the cross section of the internal-conductor hole in the inside of the dielectric block differs from the size of the cross section in a portion in the vicinity of each open end, and the sizes of the cross sections in at least one of the layers of the internal-conductor hole in which is formed the internal conductor to which the balanced terminal is coupled and the internal-conductor hole in which is formed the internal conductor to which the unbalanced terminal is coupled are different. With this construction, the resonance frequencies which are different between the internal conductor which is coupled to the balanced terminal and the internal conductor which is coupled to the unbalanced terminal are made to match. Furthermore, the external coupling capacitance can be set as desired.

The internal-conductor holes may be formed into a tapered structure in which the size of the cross section of the internal-conductor hole increases from the inner portion toward the opening, and the sizes of the cross sections at a given distance from the openings at one end, of the internal-conductor hole in which is formed the internal conductor to which the balanced terminal is coupled, and the internal-conductor hole in which is formed the internal conductor to which the unbalanced terminal is coupled, are different. With this construction, the resonance frequencies which are different between the internal conductor which is coupled to the balanced terminal and the internal conductor which is coupled to the unbalanced terminal are made to match, and the external coupling capacitance can be adjusted as desired. Moreover, the molding of internal-conductor holes becomes easier.

In another aspect, the present invention provides a dielectric filter provided with a plurality of internal-conductor holes, each having an internal conductor formed on the surface thereof inside a dielectric block which has a substantially rectangular parallelepiped shape, having both ends or portions in the vicinity of both ends being formed as open ends, and having an external conductor formed on the outer surface of the rectangular parallelepiped. The dielectric filter comprises a pair of balanced terminals which are each coupled to one respective portion in the vicinity of one of the open ends of the internal conductor formed in a predetermined one of the internal-conductor holes; and an unbalanced terminal which is coupled to a portion in the vicinity of one of the open ends of the internal conductor formed in another one of the internal-conductor holes. An external-conductor-removed section in which the external conductor is partially removed is provided in the vicinity of the other open end of the internal-conductor hole in which is formed the internal conductor to which the unbalanced terminal is coupled. With this construction, the resonance frequencies which are different between the internal conductor which is coupled to the balanced terminal and the internal conductor which is coupled to the unbalanced terminal are made to match.

In the dielectric filter of the present invention, preferably, the sizes of the cross sections of the internal-conductor hole in which is formed the internal conductor to which the balanced terminal is coupled, and the internal-conductor hole in which is formed the internal conductor to which the unbalanced terminal is coupled are different. Or the internal-conductor holes may be formed into a stepped structure made up of plural layers, in which the size of the cross section of each internal-conductor hole in the inside of the dielectric block differs from the size of the cross section in a portion in the vicinity of an open end, and the sizes of the cross sections in at least one of the layers of the internal-conductor hole in which is formed the internal conductor to which the balanced terminal is coupled and the internal-conductor hole in which is formed the internal conductor to which the unbalanced terminal is coupled are different. Or the internal-conductor holes may be formed into a tapered structure in which the size of the cross section of the internal-conductor hole increases from the inner portion toward an opening, and the sizes of the cross sections in the inside at the same distance from the opening of the internal-conductor hole in which is formed the internal conductor to which the balanced terminal is coupled and the internal-conductor hole in which is formed the internal conductor to which the unbalanced terminal is coupled are different. In any of the foregoing structures, an external-conductor-removed section in which an external conductor is partially removed may also be provided in a portion in the vicinity of an open end of the internal-conductor hole in which is formed the internal conductor to which the unbalanced terminal is coupled. With this construction, similar to that described above, the resonance frequencies which are different between the internal conductor which is coupled to the balanced terminal and the internal conductor which is coupled to the unbalanced terminal are made to match, and the external coupling capacitance can be adjusted as desired.

On the outer surface of the dielectric filter of the present invention, preferably, a floating electrode, which is separated from the external conductor by the external-conductor-removed section, is formed in a portion in the vicinity of the open end on the unbalanced terminal side. With this construction, the resonance frequencies which are different between the internal conductor which is coupled to the balanced terminal and the internal conductor which is coupled to the unbalanced terminal are made to match.

In another aspect, the present invention provides a dielectric duplexer formed of a plurality of dielectric filters and having predetermined filtering characteristics.

In another aspect, the present invention provides a communication apparatus formed by using the dielectric filter and/or the dielectric duplexer. As a result, a compact and lightweight communication apparatus is obtained.

The above and further aspects and novel features of the invention will become more fully apparent from the following detailed description when read in conjunction with the accompanying drawings.

DETAILED DESCRIPTION OF EMBODIMENTS OF THE INVENTION

Figure 1A:
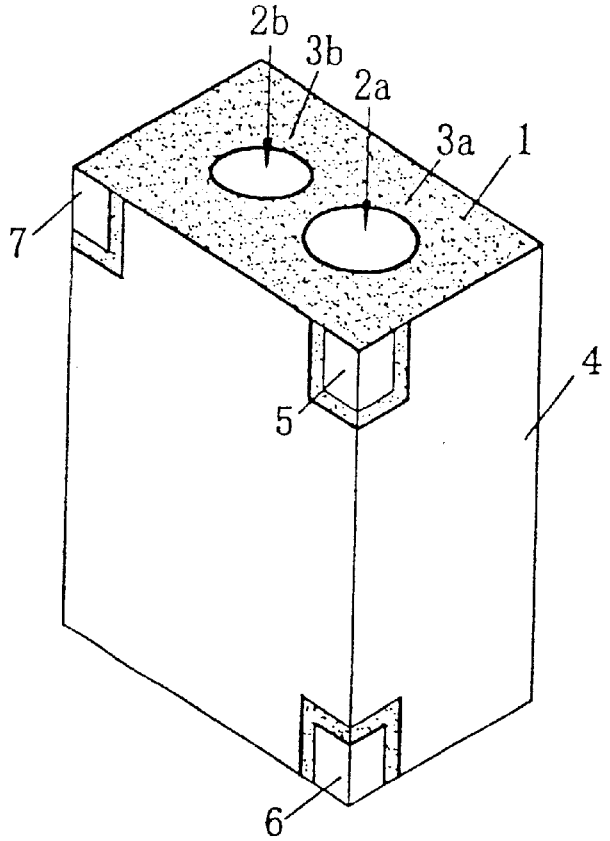
FIGS. 1A and 1B are an exterior perspective view and a sectional view of a dielectric filter according to a first embodiment of the present invention.
Figure 1B:
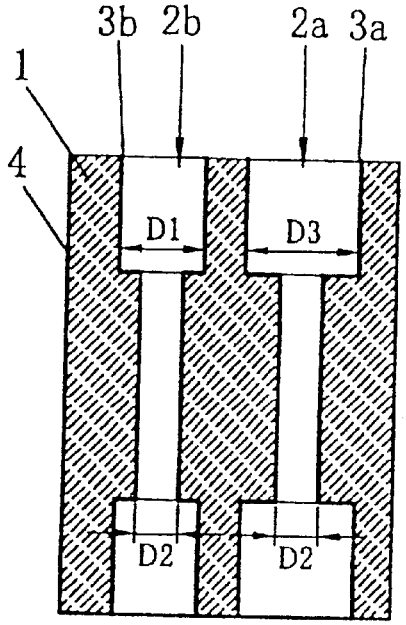

The construction of a dielectric filter according to a first embodiment of the present invention will now be described below with reference to FIGS. 1A and 1B. FIG. 1A is an exterior perspective view of the dielectric filter. FIG. 1B is a sectional view taken along the plane passing through internal-conductor holes 2*a* and 2*b*.

Referring to FIGS. 1A and 1B, reference numeral 1 denotes a dielectric block which has a substantially rectangular parallelepiped shape. Inside the dielectric block 1, internal-conductor holes 2*a* and 2*b*, both ends of which are open, having internal conductors 3*a* and 3*b* formed on the inner surfaces thereof, are formed from the top surface toward the bottom surface in the figure. Also, on the outer surface of the dielectric block 1, an external conductor 4 is formed over four surfaces, but not on the surfaces having the openings of the internal-conductor holes 2*a* and 2*b*. Furthermore, on the outer surface of the dielectric block 1, a pair of balanced terminals 5 and 6 which are respectively coupled to the two openings of the internal-conductor conductor hole 2*a* are formed separately from the external conductor, and an unbalanced terminal 7 which is coupled to one of the openings of the internal-conductor conductor hole 2*b* is formed separately from the external conductor.

As shown in FIG. 1B, the internal-conductor holes 2*a* and 2*b* are formed with a stepped structure. The size of the cross section of the internal-conductor hole 2*b* on the unbalanced terminal side (when the internal-conductor hole is a circular hole, the size is hereinafter referred to simply as an "inner diameter") is denoted as D2 in the central portion and as D1 at the ends, and the inner diameter of the internal-conductor hole 2*a* on the balanced terminal side is denoted as D2 in the central portion and as D3 at the ends, so as to satisfy the relationship of D3>D1.

The respective inner diameters of the central portions of the internal-conductor holes 2*a* and 2*b* may not be the same. Also, the internal-conductor holes 2*a* and 2*b* may be elliptical or rectangular in addition to circular in shape.

Next, the construction of a dielectric filter according to a second embodiment of the present invention will be described below with reference to FIG. 2.

Figure 2:
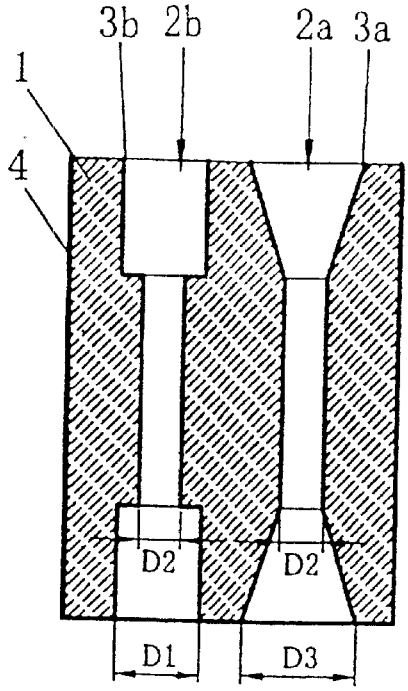
FIG. 2 is a sectional view of a dielectric filter according to a second embodiment of the present invention.

FIG. 2 is a sectional view along a plane passing through the two internal-conductor holes 2*a* and 2*b*. The exterior perspective view thereof is the same as that shown in FIG. 1A. As shown in FIG. 2, the internal-conductor hole 2*b* has a stepped structure, in which the inner diameter of the central portion is denoted as D2, and the inner diameter of the end portions is denoted as D1. In contrast, the internal-conductor hole 2*a* inside the dielectric block 1 has a cylindrical portion having a diameter of D2 and extending in the axial direction for a predetermined length, and has conical sections, the cross sections of which are each tapered from a predetermined point along the cylindrical portion, toward respective ones of the two openings. In this example, the inner diameter D3 of the opening of the internal-conductor hole 2*a* is formed greater than D2 and D1.

The respective inner diameters of the central portions of the internal-conductor holes 2*a* and 2*b* do not have to be the same. Also, the internal-conductor hole may be elliptical or rectangular in addition to circular. In this manner, as a result of forming the internal-conductor hole into a tapered structure, it is easy to manufacture a molding die for a dielectric block, and the molding process becomes easier.

Although in the example shown in FIG. 2, one of two internal-conductor holes is formed into a stepped structure and the other is formed into a tapered structure, both may be formed into a tapered structure.

As described in the first and second embodiments, since the step ratio D3:D2 of the internal-conductor hole 2*a* on the balanced terminal side is greater than the step ratio D1:D2 of the internal-conductor hole 2*b* on the unbalanced terminal side, an increase in the resonance frequency of the resonator formed by the internal conductor 3*a*, which occurs as a result of providing terminals for external coupling in the vicinity of both open ends, is suppressed. Also, since the spacing between portions in the vicinity of the open ends of the internal conductor 3*a* and the balanced terminals 5 and 6 is decreased, the external coupling capacitance is increased, thereby making it possible to easily obtain impedance matching when a balanced line having a high impedance is connected, and low loss characteristics can be obtained.

Next, the construction of a dielectric filter according to a third embodiment of the present invention will be described below with reference to FIG. 3.

Figure 3:
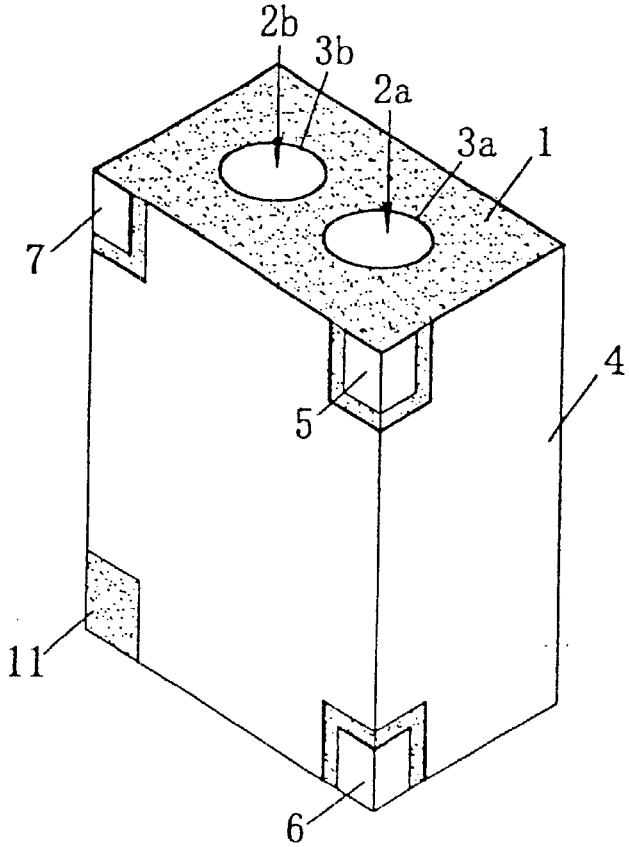
FIG. 3 is an exterior perspective view of a dielectric filter according to a third embodiment of the present invention.
Figure 8A:
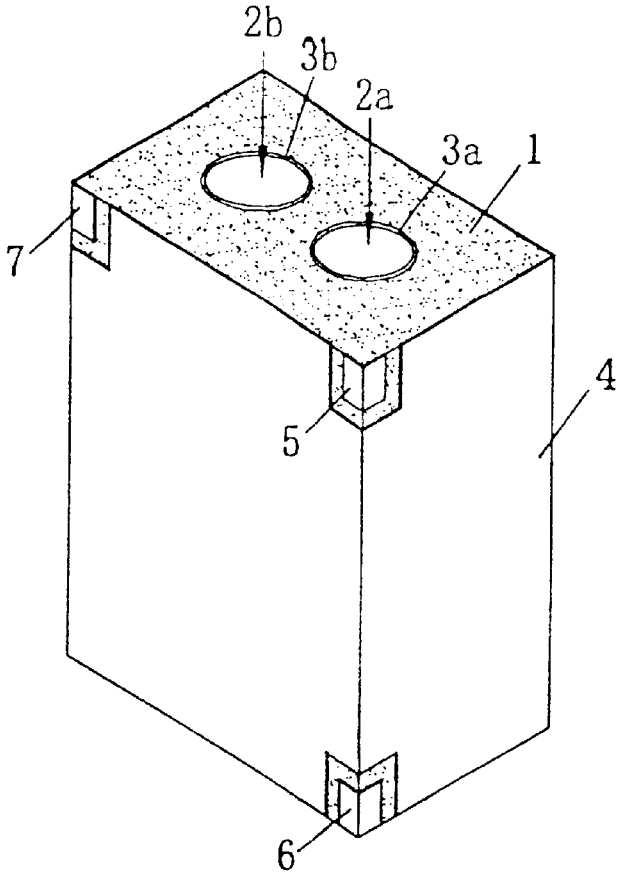
FIG. 8A PRIOR ART
FIGS. 8A and 8B are an exterior perspective view and a sectional view of a conventional dielectric filter.
Figure 8B:
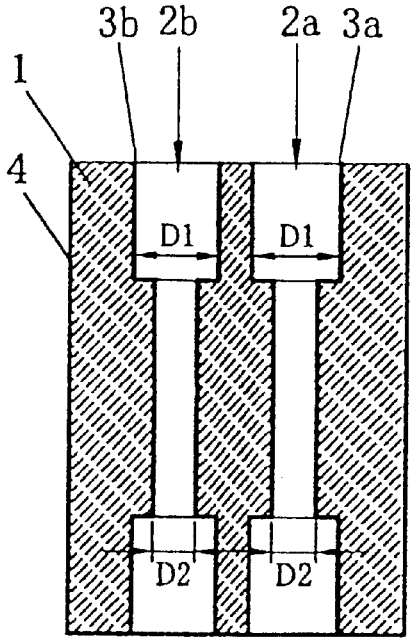
FIG. 8B PRIOR ART

FIG. 3 is an exterior perspective view of the dielectric filter. Referring to FIG. 3, reference numeral 1 denotes a dielectric block which has a substantially rectangular parallelepiped shape. Inside the dielectric block 1, internal-conductor holes 2*a* and 2*b*, which have a similar shape, in which both ends thereof are open and internal conductors 3*a* and 3*b* are provided on the inner surfaces, are formed from the top surface to the bottom surface in the figure. The cross-sectional shape of this dielectric filter is the same as that shown in FIG. 8B. The outer surface of the dielectric block 1 is formed with an external conductor 4 over four surfaces, but not on the surfaces having the openings of the internal-conductor holes. Furthermore, the outer surface of the dielectric block 1 is formed with a pair of balanced terminals 5 and 6 which are each coupled to one of the open ends of the internal conductor 3*a*, and an unbalanced terminal 7 which is coupled to one of the open ends of the internal conductor 3*b*. Furthermore, an external-conductor-removed section 11 is formed in the vicinity of the other open end of the internal-conductor hole 2*b*. This external-conductor-removed section 11 may be formed not only on the left front surface in the figure, but also on the right rear surface, and furthermore, may be formed in such a manner as to extend from the left front surface to the right rear surface. With such a construction, the difference in the resonance frequency of the resonator formed by the internal conductors between the balanced terminal side and the unbalanced terminal side can be corrected.

Next, the construction of a dielectric filter according to a fourth embodiment of the present invention will be described with reference to FIGS. 4A and 4B.

Figure 4A:
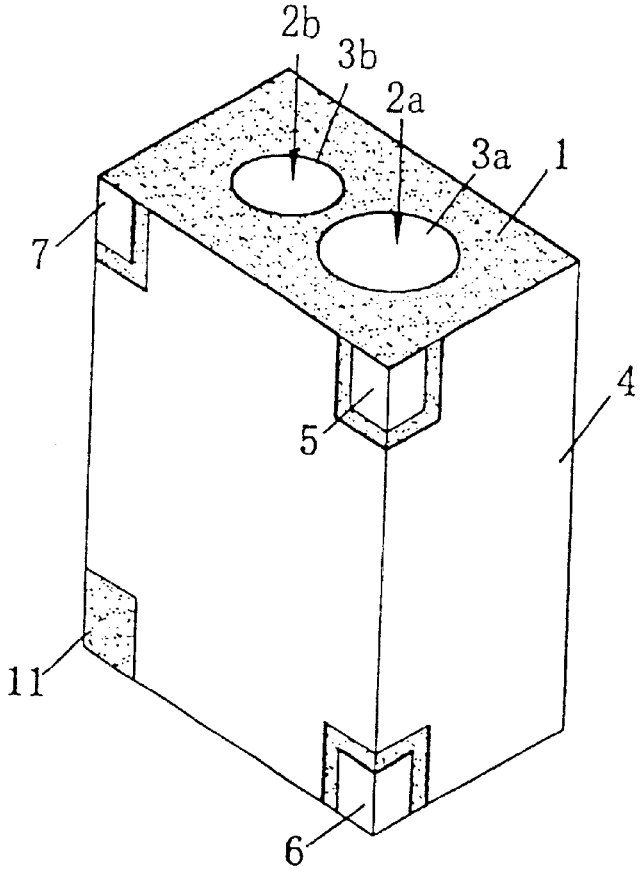
FIGS. 4A and 4B are an exterior perspective view and a sectional view of a dielectric filter according to a fourth embodiment of the present invention.
Figure 4B:
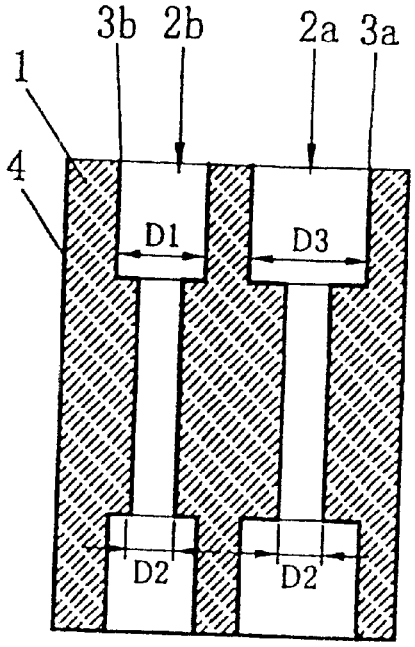

FIGS. 4A and 4B show that the construction of the internal conductors is changed in the dielectric filter according to the third embodiment. FIG. 4A is an exterior perspective view thereof. FIG. 4B is a sectional view taken along the plane passing through the internal-conductor holes 2*a* and 2*b*. In FIGS. 4A and 4B, for the internal-conductor holes of the dielectric filter, the inner diameter on the opening side of the internal-conductor hole on the balanced terminal side is different from that on the unbalanced terminal side. On the other hand, the outer surface is formed in such a way that, similar to that described in the third embodiment, an external-conductor-removed section 11 is provided in the external conductor 4 at one end of the internal-conductor hole 2*b* on the unbalanced terminal side.

In the manner described above, as a result of forming the construction in such a manner as to have the constructions of both of the above-described two embodiments, it is possible to cause the resonance frequencies of the balanced terminal side and the unbalanced terminal side to match, and it becomes easy to obtain a predetermined external coupling capacitance.

The internal-conductor hole may be formed into a tapered structure, as shown in FIG. 2.

Next, the construction of a dielectric filter according to a fifth embodiment of the present invention will be described with reference to FIG. 5.

Figure 5:
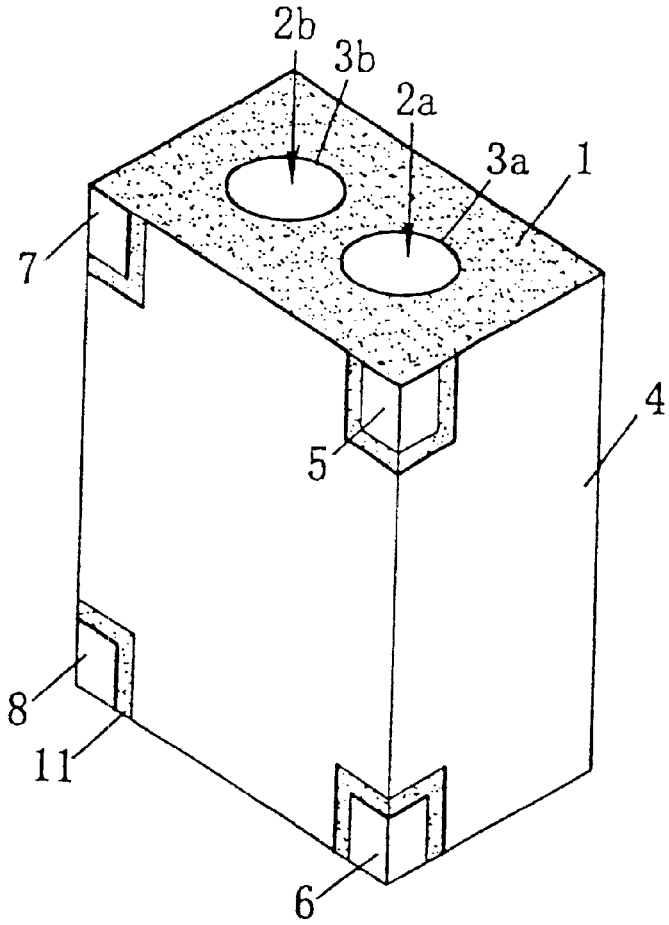
FIG. 5 is an exterior perspective view of a dielectric filter according to a fifth embodiment of the present invention.

FIG. 5 is an exterior perspective view of a dielectric filter having a floating electrode 8 separated from the external conductor 4 within an external-conductor-removed section 11. In this manner, even if the floating electrode 8 is provided, it is possible to cause the resonance frequencies of the resonators formed by the internal conductors to match between the balanced terminal side and the unbalanced terminal side, as in the third embodiment.

As the construction of internal-conductor holes, the constructions described in the first, second, and third embodiments may be combined. With such a construction, it is possible to cause the resonance frequencies of the balance terminal side and the unbalance terminal side to match, and it becomes possible to cause a predetermined external coupling capacitance to occur.

Next, the construction of a dielectric duplexer according to a sixth embodiment of the present invention will be described with reference to FIGS. 6A and 6B.

Figure 6A:
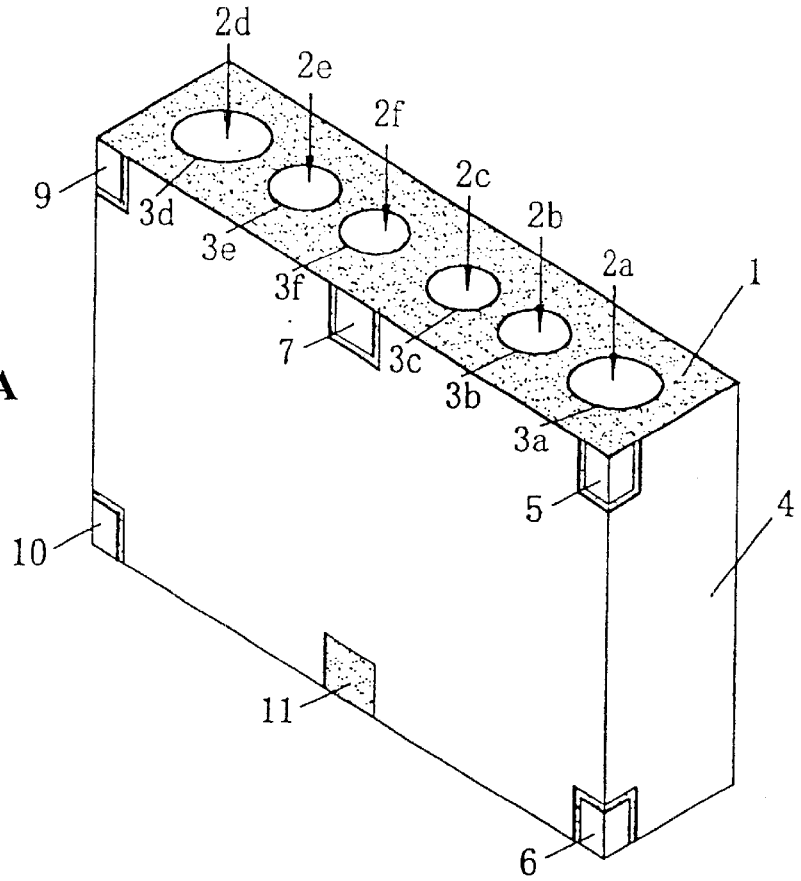
FIGS. 6A and 6B are an exterior perspective view and a sectional view of a dielectric duplexer according to a sixth embodiment of the present invention.
Figure 6B:
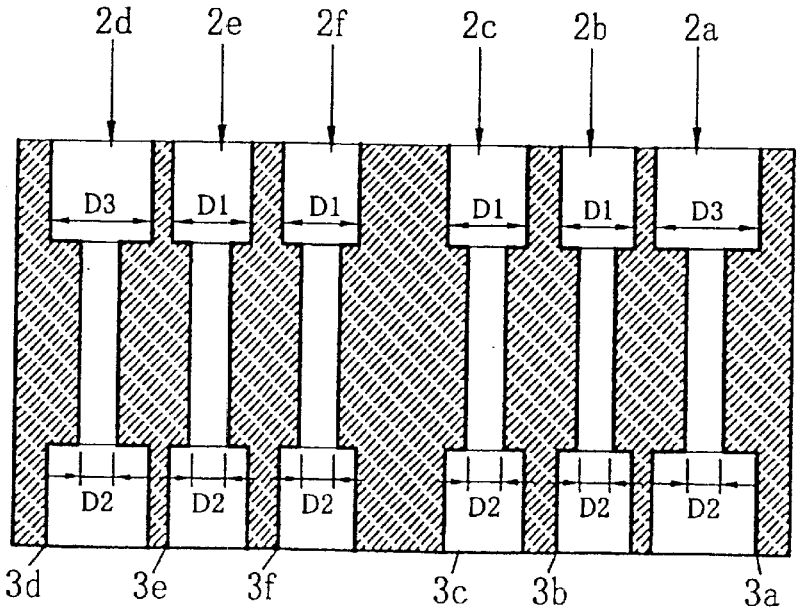

FIG. 6A is an exterior perspective view of the dielectric duplexer. FIG. 6B is a sectional view taken along the plane passing through internal-conductor holes. The left front side in the figure in the direction shown in FIG. 6A is. provided for facing a circuit substrate (not shown), and surface mounting is performed in such a way that balanced terminals 5, 6, 9, and 10 and an unbalanced terminal 7 are connected as input/output terminals.

Referring to FIG. 6A, reference numeral 1 denotes a dielectric block having a substantially rectangular parallelepiped shape, and internal-conductor holes 2*a* to 2*f*, in which the inner diameters of the holes 2*a* and 2*d* and the inner diameters of the holes 2*b*, 2*c*, 2*e* and 2*f* are different. Internal conductors 3*a* to 3*f*, both ends of which are open, are provided on the inner surfaces thereof. Also, the outer surface is formed with an external conductor 4 over four surfaces, but not on the surfaces having the openings of the internal-conductor holes. The balanced terminals 5, 6, 9, and 10 are coupled to the internal conductors 3*a* and 3*d* and an unbalanced terminal 7 is coupled to the internal conductors 3*c* and 3*f*. An external-conductor-removed section 11 is formed in the external conductor 4 in the vicinity of the openings at one end of,. the internal-conductor holes 2*c* and 2*f*. With this construction, a dielectric duplexer is constructed in which the dielectric filter formed by the internal conductors 3*a* to 3*c* serves as a transmission filter, the dielectric filter formed by the internal conductors 3*d* to 3*f* serves as a receiving filter, the unbalanced terminal 7 serves as an antenna terminal, the balanced terminals 5 and 6 serve as transmission signal input terminals, and the balanced terminals 9 and 10 serve as receiving signal output terminals.

The construction of the internal-conductor hole may be similar to that described in the first and second embodiments. Furthermore, the construction may also be formed in such a way that a floating electrode is provided in the external-conductor-removed section.

In the dielectric filters and the dielectric duplexers shown in FIGS. 1A to 6B, internal-conductor holes of a stepped structure or a tapered structure are provided inside a dielectric block. However, the same operation and effect can be obtained even with internal-conductor holes having a straight structure. and a fixed inner diameter, and a coupling hole formed between adjacent internal-conductor holes.

Furthermore, although in the examples shown in FIGS. 1A to 6B, a dielectric resonator is formed in which the end surface of the dielectric block, which is open without forming an external conductor, is the open end of the resonator, the construction may be formed in such a way that a section on which an internal-conductor is not formed (internal-conductor-removed section) is provided in the inside of the internal-conductor hole or in a portion in the vicinity of the opening thereof without providing an open surface on the outer surface of the dielectric block.

Next, the construction of a communication apparatus using the dielectric filter and/or the dielectric duplexer will be described with reference to FIG. 7.

Figure 7:
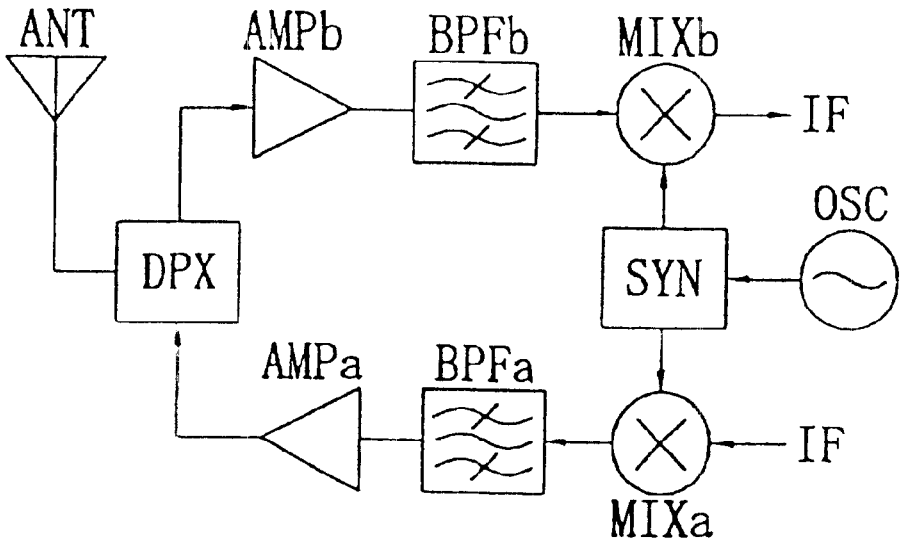
FIG. 7 is a block diagram showing the construction of a communication apparatus according to a seventh embodiment of the present invention.

Referring to FIG. 7, reference letter ANT denotes a transmission/receiving antenna. Reference letter DPX denotes a duplexer Reference letters BPFa and BPFb each denote a band-pass filter. Reference letters AMPa and AMPb each denote an amplifying circuit. Reference letters MIXa and MIXb each denote a mixer. Reference letter OSC denotes an oscillator. Reference letter SYN denotes a synthesizer. Reference letter IF denotes an intermediate frequency signal.

The mixer MIXa mixes a modulation signal and a signal output from the synthesizer SYN. The band-pass filter BPFa allows only the frequencies in the transmission band of the mixed output signal from the mixer MIXa to pass. The amplifying circuit AMPa current-amplifies this signal and transmits it from the transmission/receiving antenna ANT via the duplexer DPX. The amplifying circuit AMPb amplifies the received signal, which is extracted from the duplexer DPX. The band-pass filter BPFa allows only the frequencies in the receiving band of the signal received from the amplifying circuit AMPb to pass. The mixer MIXb allows only the frequencies in the receiving band of the received signal output from the synthesizer SYN to pass. The mixer MIXb mixes the frequency signal output from the synthesizer SYN and the received signal and outputs an intermediate frequency signal IF.

For the duplexer DPX portion shown in FIG. 7, it is possible to use a duplexer of the construction shown in FIG. 6. Also, for the band-pass filters BPFa and BPFb, a dielectric filter of the construction shown in FIGS. 1A to 5 may be used. In this manner, since a filter or a duplexer, which is small as a whole, having a balanced-to-unbalanced transform function and superior filtering characteristics, is provided a compact and lightweight communication apparatus having superior communication performance can be constructed.

According to the present invention, a dielectric filter or a dielectric duplexer with a balanced-to-unbalanced transform function, which is capable of correcting the mismatch of resonance frequencies between the balanced terminal side and the unbalanced terminal side and which shows superior band-pass characteristics, can be obtained.

According to the present invention, a dielectric filter or a dielectric duplexer which is capable of correcting the mismatch of external coupling, due to the fact that the characteristic impedance of a line, which is coupled to an external source, is different, and which has superior reflection loss characteristics, can be obtained.

According to the present invention, a communication apparatus, which is small and light as a whole, having a predetermined communication performance, can be constructed.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A dielectric filter comprising:

a plurality of internal-conductor holes, each having an internal conductor formed on a surface thereof inside a dielectric block which has a substantially rectangular parallelepiped shape, each hole having two ends and the portions in the vicinity of both ends being open ends, and an external conductor formed on the outer surface of said dielectric block;

a pair of balanced terminals, each being coupled to the vicinity of a respective one of the open ends of the internal conductor formed in a predetermined one of said internal-conductor holes; and an unbalanced terminal which is coupled to the vicinity of one of the open ends of the internal conductor formed in another one of said internal-conductor holes, wherein the sizes of the cross sections of said internal-conductor hole in which is formed the internal conductor to which said balanced terminal is coupled and said internal-conductor hole in which is formed the internal conductor to which said unbalanced terminal is coupled are different.

2. A dielectric filter according to claim 1, wherein said internal-conductor holes have a stepped structure, in which the size of the cross section of each internal-conductor hole in the inside of said dielectric block differs from the size of the cross section in the vicinity of its open ends, and the size of the cross section of at least one portion of the internal-conductor hole in which is formed the internal conductor to which said balanced terminal is coupled is different from the size of the cross-section of a corresponding portion of the internal-conductor hole in which is formed the internal conductor to which said unbalanced terminal is coupled.

3. A dielectric filter according to claim 1, wherein said internal-conductor holes have a tapered structure in which the size of the cross section of the internal-conductor hole increases from an inner portion of said hole toward each open end, and the respective cross-sectional sizes of the internal-conductor hole in which is formed the internal conductor to which said balanced terminal is coupled and the, internal-conductor hole in which is formed the internal conductor to which said unbalanced terminal is coupled at a given distance from an end of said dielectric block are different.

4. A dielectric filter according to one of claims 1, 2 and 3, wherein an external-conductor-removed section in which an external conductor is partially removed is provided in the vicinity of the other open end of said internal-conductor hole in which is formed the internal conductor to which said unbalanced terminal is coupled.

5. A dielectric filter according to claim 4, wherein a floating electrode, which is separated from said external conductor by the external-conductor-removed section, is provided in said external-conductor-removed section.

6. A dielectric filter comprising:

a plurality of internal-conductor holes, each having an internal conductor formed on a surface thereof inside a dielectric block which has a substantially rectangular parallelepiped shape, each hole having two ends and portions in the vicinity of both ends being open ends, and an external conductor formed on the outer surface of said dielectric block;

a pair of balanced terminals each being coupled to the vicinity of a respective one of the open ends of the internal conductor formed in a predetermined one of said internal-conductor holes; and an unbalanced terminal which is coupled to the vicinity of one of the open ends of the internal conductor formed in another one of said internal-conductor holes, wherein an external-conductor-removed section in which an external conductor is partially removed is provided in the vicinity of the other open end of said internal-conductor hole in which is formed the internal conductor to which the unbalanced terminal is coupled.

7. A dielectric filter according to claim 6, wherein a floating electrode, which is separated from said external conductor by the external-conductor-removed section, is provided in said external-conductor-removed section.

8. A communication apparatus comprising a high-frequency circuit, and connected thereto, a dielectric filter according to one of claims 1, 2, 3 and 6.

9. A dielectric duplexer comprising a pair of dielectric filters according to one of claims 1, 2, 3 and 6, the respective unbalanced terminals of said pair of filters being connected in common to an antenna terminal of said duplexer;

the balanced terminals of one of said filters being usable as transmission signal input terminals of said duplexer; and the balanced terminals of the other of said filters being usable as receiving signal output terminals of said duplexer.

10. A communication apparatus comprising a high-frequency circuit, and connected thereto, a dielectric duplexer according to claim 9.

* * * * *